United States Patent [19]

Taylor et al.

[11] 4,121,780

[45] Oct. 24, 1978

[54] PRE-STRESSING OF CONCRETE PRESSURE VESSELS

[75] Inventors: Reginald Sidney Taylor, Gerrards Cross; Reginald Edwin Downton Burrow, Bassett; John Morton Mason, High Wycombe; John Richard Portas, Ruislip; William David Thomas, Hounslow, all of England

[73] Assignee: Taylor Woodrow Construction Limited, Southall, England

[21] Appl. No.: 613,023

[22] Filed: Sep. 12, 1975

Related U.S. Application Data

[63] Continuation-in-part of Ser. No. 534,850, Dec. 23, 1974, abandoned, which is a continuation of Ser. No. 128,592, Mar. 26, 1971, abandoned, which is a continuation of Ser. No. 659,924, Aug. 11, 1967, abandoned.

[51] Int. Cl.[2] ..... B65H 81/06

[52] U.S. Cl. ..... 242/7.21

[58] Field of Search ..... 242/7.21, 7.22, 7.23, 242/7.01, 75.2, 75.53; 226/172, 195

[56] References Cited

U.S. PATENT DOCUMENTS

| | | | |
|---|---|---|---|
| 2,321,465 | 6/1943 | Crom | 242/7.02 |
| 2,364,696 | 12/1944 | Crom | 242/7.21 X |
| 2,520,402 | 8/1950 | Hirsch | 242/7.22 |
| 2,711,291 | 6/1955 | Kennedy | 242/7.22 |
| 2,797,878 | 7/1957 | Crom, Jr. | 242/7.21 |
| 3,065,893 | 11/1962 | Basford | 226/172 |
| 3,104,791 | 9/1963 | Anrig | 226/172 |
| 3,255,976 | 6/1966 | Mede | 242/7.21 |
| 3,380,675 | 4/1968 | Baxter et al. | 242/7.21 |
| 3,452,940 | 7/1969 | Brandestini | 242/7.21 X |
| 3,773,270 | 11/1973 | Brandestini | 242/7.21 |

*Primary Examiner*—Billy S. Taylor

*Attorney, Agent, or Firm*—Haseltine, Lake, & Waters

[57] ABSTRACT

A temporary platform encircling a concrete pressure vessel carries endless rails on which a mobile unit runs. The unit has a supply drum from which is drawn pre-stressing wire anchored at its free end in one of many channels in the outside wall of the vessel. The wire leaves the unit via a tensioning unit and a payout sheave both carried by the mobile unit. Hoist ropes fixed at intervals around the platform and connected to winches lift and lower the platform to locate the sheave at the level of each channel in turn.

18 Claims, 11 Drawing Figures

PRE-STRESSING OF CONCRETE PRESSURE VESSELS

CROSS-RELATED APPLICATION

This Application is a continuation-in-part of co-pending application Ser. No. 535,850 filed Dec. 23, 1974 now abandoned which is a continuation of Ser. No. 128,592 filed Mar. 26, 1971 now abandoned which in turn is a continuation of Ser. No. 659,924 filed Aug. 11, 1967 and now abandoned.

FIELD OF THE INVENTION

This invention is concerned primarily with the circumferential stressing of concrete pressure vessels such as may, for example, be employed in nuclear power stations or for the storage of gas or other medium under pressure.

BACKGROUND

It is known to suspend from the top of a structure around which wire is to be wound a mobile unit capable of holding a supply of wire in such a manner that said wire may be drawn therefrom, the unit being appropriately positioned and supported in relation to any selected circumferential trough or channel in or on the surface of the structure around which the wire is to be wound, so that, when the unit is carried around the structure at a desired speed and with one end of the wire securely anchored in the selected trough or channel, the wire will be wound around the structure.

In our prior U.S. Pat. No. 3,404,497 we have described a concrete pressure vessel or other concrete structure which is circumferentially stressed by means of prestressing wire or strands wound therearound under tension in a plurality of layers, such wire or strands being accommodated in circumferential troughs or channels which are provided in or on the outer surface of the vessel and serve to locate the layers of wire.

SUMMARY OF THE INVENTION

According to the present invention, there is provided apparatus for winding prestressing wire around a cylindrical vessel or structure, such apparatus comprising a platform or staging adapted to surround the vessel or structure and capable of being located at a selected height in relation thereto and a mobile unit which is supported on said platform for movement around the vessel and adapted to hold a supply of wire in such a manner that said wire may be drawn therefrom, the arrangement being such that with an end of the wire securely anchored to the vessel, movement of the unit therearound will result in winding of the wire around said vessel.

In order that the said invention may be clearly understood and readily carried into effect reference will now be made to the accompanying diagrammatic drawings.

DETAILED DESCRIPTION

In the following description it will be assumed that it is required to wind prestressing wire around a cylindrical pressure vessel, the outer surface of which is, as described in U.S. Pat. No. 3,404,497 provided with a plurality of circumferentially extending troughs or channels for the reception of the wire.

Figure 1:
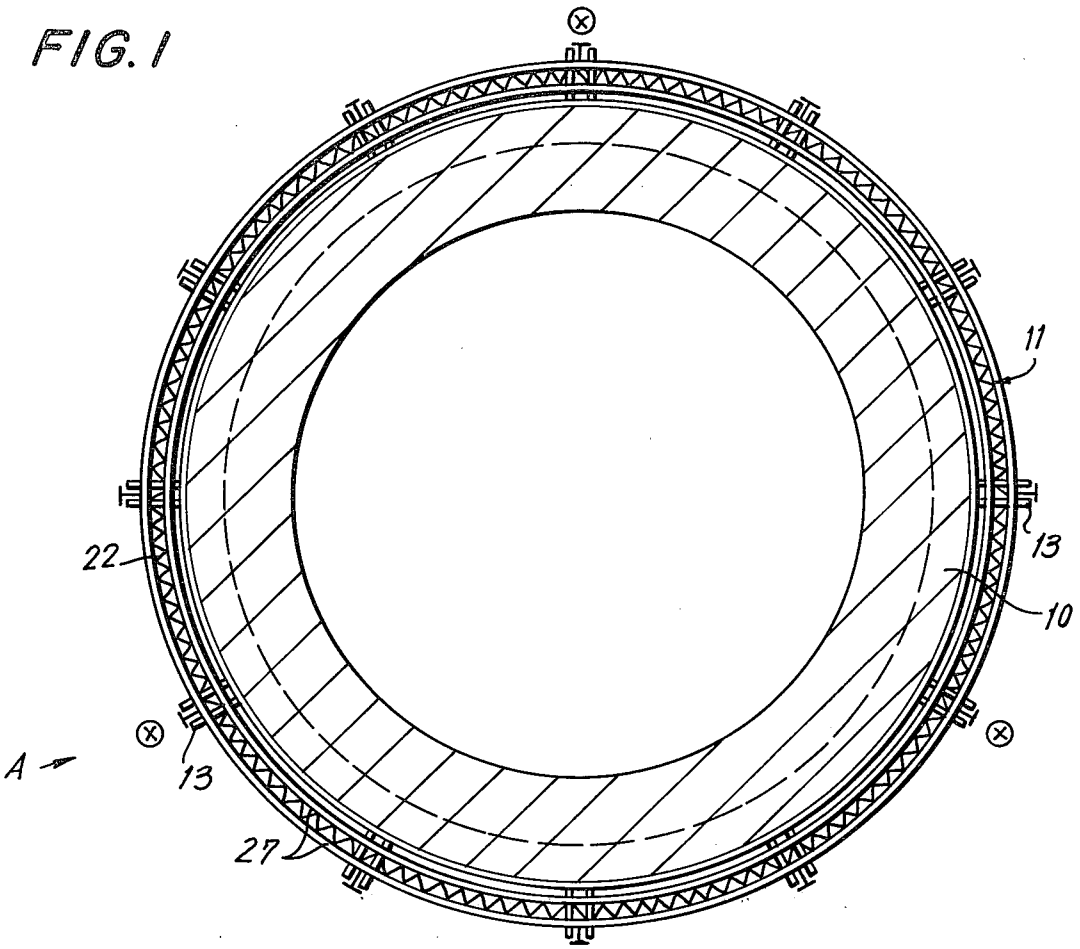
FIG. 1 is a plan view of a platform or staging which is adapted to be erected around a pressure vessel and serves to support the wire winding equipment.

Referring now to the drawings, 10 denotes such a pressure vessel while 11 denotes a substantially annular platform or staging which is so supported that it is capable of vertical movement upwardly and downwardly relatively to the vessel. The annular platform or staging is supported for vertical movement by means of a plurality of hoist ropes or cables 12 which are attached thereto at spaced points therearound and are passed around sheaves or pulleys 15 located at the upper ends of vertical columns or masts 13 disposed at appropriately spaced points around the outer periphery of said staging or platform. In the embodiment illustrated, it is proposed to support the platform 11 by means of three pairs of hoist ropes at 120° angular intervals around the periphery of the platform at stations X as shown in FIG. 1, and the ropes of each pair are arranged as illustrated in FIG. 3.

Figure 3:
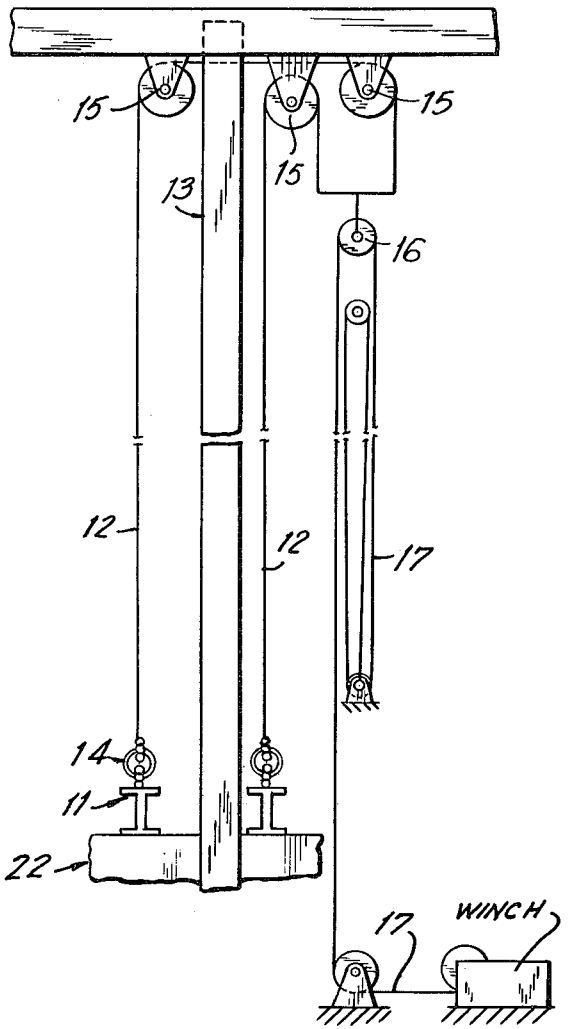
FIG. 3 is a view taken in the direction of arrow A in FIG. 1 illustrating an arrangement of hoist ropes for the platform.

Referring to FIG. 3, it will be seen that a pair of ropes 12 which are attached to the platform through the medium of strain screws 14 are passed over the sheaves 15 mounted at the upper ends of the columns or masts 13 to a member carrying a sheave 16 around which a single hoist rope 17 passes, such rope 17 being passed around an appropriate sheave system and being coupled to a winch which is driven through the medium of an electric motor or other prime mover (not shown). The three motors or prime movers of the three winches are synchronized so that on operation thereof in one direction or the other the staging or platform will be raised or lowered while being maintained in a horizontal or substantially horizontal plane. If desired, electro-magnetic or other appropriate devices may be incorporated to ensure that the staging or platform will be maintained substantially level during movement. In order that the staging or platform may be located in any desired predetermined horizontal plane or at a predetermined height in relation to the pressure vessel, provision is made whereby the staging or platform may, on being moved into such predetermined position can be locked in place. To this end, all or certain of the columns or masts 13 will be provided at appropriately spaced intervals along their length with support blocks 18 (FIG. 2) while the platform 11 will be provided at each of an appropriate number of angularly displaced points with a projectable and retractable bearing bolt 19, such bolts being capable of being moved into and out of operative position by hydraulic cylinders 19*a* mounted on the platform wherein they will serve to cooperate with the appropriate support blocks 18 thereby to hold or lock the staging or platform. Additionally for the purpose of positively locating the platform 11, the latter is equipped at its inner periphery adjacent the wall of the vessel 10 with a plurality of hydraulically or pneumatically operated arms one of which is indicated at 20 in FIG. 2. As will be seen, the arm 20, which is pivoted at 21 on a member forming part of the platform sub-frame 22, is adapted to be moved angularly about its pivot 21 by means of a fluid-pressure operated cylinder 23 mounted on the platform thereby to bring a support block 24 carried on arm 20 into and out of a position wherein it will cooperate with the wall of a selected circumferential trough or channel around the outer surface of the pressure vessel 10. Since certain irregularities or tolerances will be present in the surfaces of the pressure vessel, provision will be made for adjustment of the block 24 on the arm 20 and also the upper end of the arm will preferably incorporate a resilient portion or section or an element which is capable of flexing so that despite irregularities in the concrete structure, the arm 20 may be caused to assume its correct operative position.

The arrangement above described is such that, when it is desired to position the platform 11 at a selected level around the vessel, the bolts 19 and the arms 20 will be moved into retracted or inoperative positions and the hoist motors will be operated to raise or lower the platform 11 as the case may be. In these retracted positions the bolts 19 and the support blocks 24 on the arms 20 will clear the support blocks 18 on the masts 13 and the outer surface of the vessel 10 respectively. On reading the selected level, the platform 11 will initially be positioned slightly above that level whereafter the bolts 19 and the arms 20 will be moved into their projected or operative positions. With the bolts 19 and arms 20 so actuated, the platform will then be lowered until the bolts 19 seat on the appropriate support blocks 18 and the support blocks 24 on the arms 20 engage the wall of the appropriate trough or channel.

At its inner periphery, the staging or platform 11 is provided with a plurality of upstanding support brackets 25 or the like which are spaced therearound and serve to support suitably housed or enclosed electrical conductors 26 from which power will be supplied to operate the wire winding unit hereinafter referred to.

Located on the staging or platform is a pair of I section rails 27 so arranged as to provide a circular track around the pressure vessel in a horizontal plane. The inner rail 27 serves to house and locate a drive chain 28 which is however so arranged as to remain stationary. Fixedly located on the upper surface of each rail 27 is an L section rail 29, the purpose of which will be hereinafter made apparent.

Disposed on the aforesaid track to travel therearound is what may be termed a train comprising two trolleys or carriages provided with running wheels or rollers 32 adapted to run on the running surfaces provided by the L section rails 29. Said trolleys or carriages are also equipped with guide roller 33 freely rotatable about vertical axes and adapted to cooperate with the vertical limbs of the rails 29, such arrangement providing lateral restraint and ensuring maintenance of said trolleys or carriages in their correct positions on the circular track. Located on the foremost trolley 30 is a hydraulic power unit or motor 34 in driving engagement with a sprocket 35 around which the aforesaid drive chain 28 is caused to pass. The output shaft of the motor 34 is drivingly coupled to sprocket 35 by belt 35*a* as diagrammatically shown in FIG. 4. Idler sprockets such as indicated at 36, 37, 38 are appropriately disposed in relation to the drive sprocket 35 in order to ensure that the drive chain 28 is appropriately looped around the latter. Preferably, the relative positions of the sprockets 36,37 will be adjustable in order to allow for maintenance of appropriate tension in the drive chain 28. As indicated above, the drive chain 28 is maintained stationary but upon operation of the hydraulic motor 34 on the leading trolley, the drive sprocket 35 will be driven thereby to cause the latter and hence the train to move along the chain 28 and around the track. The hydraulic motor 34 is reversible so that the drive sprocket can be driven in opposite directions and thereby the train can be driven in forward or reverse direction around the track. Alternatively, the chain 28 could be replaced by fixed teeth on the outside wall of the vessel or structure 10, the drive sprocket 35 engaging these fixed teeth.

Figure 5:
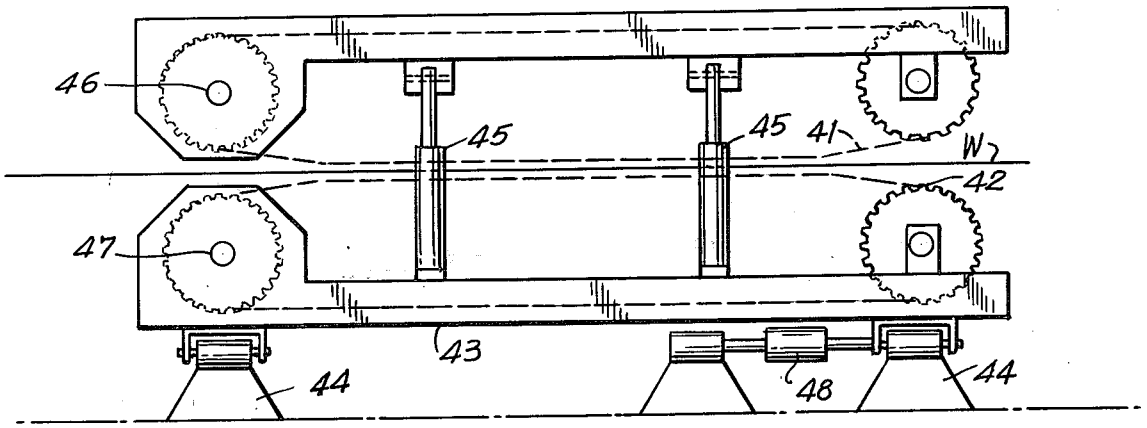
FIG. 5 is a side elevational view on a larger scale of a tensioning unit employed in the assembly shown in FIG. 4.
Figure 6:
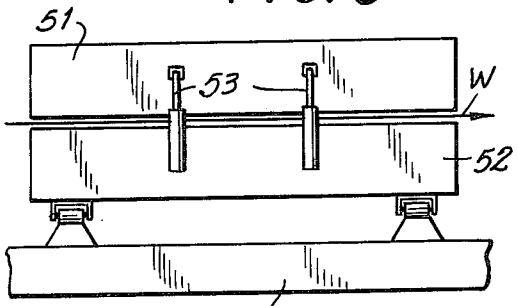
FIG. 6 is a diagrammatic side elevational view of a modified tensioning unit.

Also located on the leading trolley or carriage 30 is a so-called payout sheave 39 around which the wire indicated at W will pass in its passage to the periphery of the pressure vessel, sheave 39 being rotatable about an axis which is adjustable or displaceable within limits as will be hereinafter explained. Located on the second trolley 31 is a wire tensioning unit 40 i.e. a unit which will apply tension to the wire to ensure that it will be wound around the vessel under a predetermined tension. Numerous means may be employed for applying the required tension but it is proposed to employ a unit such as is indicated in FIG. 5, such unit comprising two endless belts or chains 41, 42 disposed vertically one above the other so that the lower flight of the upper belt or chain 41 will be in contact with or closely adjacent to the upper flight of the lower belt or chain 42. The support frame or structure 43 for one of the belts or chains in the embodiment illustrated is so supported on floating mountings 44 as to be capable of a limited floating movement in a fore and aft direction. In addition, the support frames or structures of the respective belts or chains are coupled together by hydraulic ram means 45 so that the belts or chains may be urged towards and into contact with each other. The belts or chains 41,42 are equipped with pads of friction gripping material (not shown). The arrangement is such that the wire W will be led from a storage spool 50 longitudinally between the two belts or chains 41, 42 to the aforesaid payout sheave 39. The belts or chains are driven by hydraulic motors 51 and it will be appreciated that by appropriate extension of the hydraulic ram means 45, the friction gripping pads on the belts or chains 41, 42 will correspondingly frictionally grip the wire and cause the wire W to advance with the belts without slippage during winding operation. The belts or chains 41,42 are driven at a speed appropriately controlled in relation to the speed of travel of the trolleys or carriages 30,31 to result in the appropriate tensioning of the wire. In the embodiment illustrated in FIG. 5, the terminal sprockets at 46, 47 around which the respective belts or chains pass, are each coupled to a respective hydraulic motor whose speed is effectively controlled through the medium of two load cells which are arranged side by side and one of which is indicated at 48. Due to the fact that the tension unit floats on the mountings 44 i.e. is capable of fore and aft movement on mountings 44, and variation in tension on the wire will result in a displacement of the tensioning unit on the mountings, and in the transmission of a signal from the load cell 48 to a control system controlling the aforesaid hydraulic motors. The load cell may be any conventional transducer known in the art and including strain gages or the like for producing an electrical output depending on load. The control systems are in themselves well known and there is no necessity for further description herein. The control arrangement is such that it will be possible accurately to control the speed differential between the belts or chains 41,42 and the carriages or trolleys 30,31 so that the tension on the wire will be maintained at a predetermined value. The tensioning unit indicated above has the advantage that the passage of the wire is linear i.e. the wire is not curved or distorted nor is it subjected to unacceptable heating or any other contingency which may adversely affect it.

As indicated above while a tensioning unit such as is described above may be preferred, other devices may well be employed. For example, the wire can be passed between stationary pressure pads or the like 51,52 operated by jacks 53 or the like which cause said pads to grip the wire as it passes therebetween thereby to apply a predetermined tension thereto. In this case the wire is pulled through the pads whereas in the embodiment in FIG. 5, the belts or chains travel with the wire.

Figure 4:
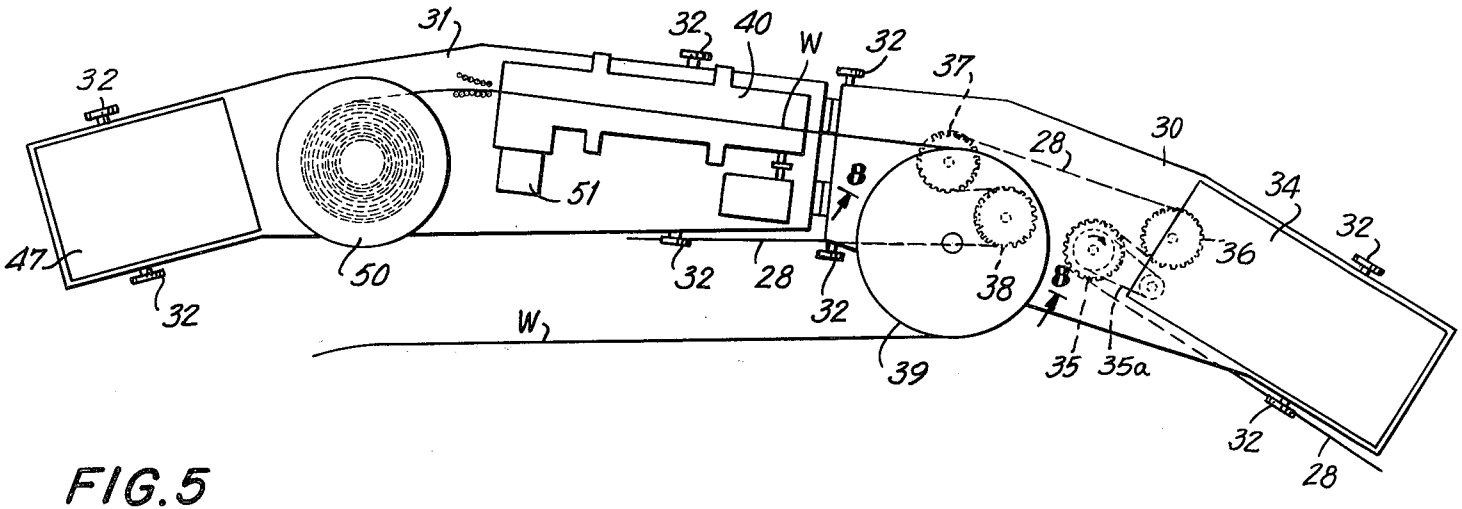
FIG. 4 is a plan view of the mobile wire winding unit.

The storage spool 50 from which the wire is led through the tension unit is located on the second or trailing trolley or carriage 31 as shown in FIG. 4 and as indicated such carriage or trolley is also equipped with an operator's control cabin as indicated at 47 adapted to house control means for the carriages or trolleys and associated items of equipment and a seat or control position for an operator.

While it is envisaged that two trolleys or carriages 30,31 will be employed, it may be feasible merely to utilize a single trolley or carriage or alternatively three or more trolleys on which the wire supply means, the tensioning unit drive means, payout sheave and the necessary control equipment will be accommodated while allowing space for an operator.

Figure 2:
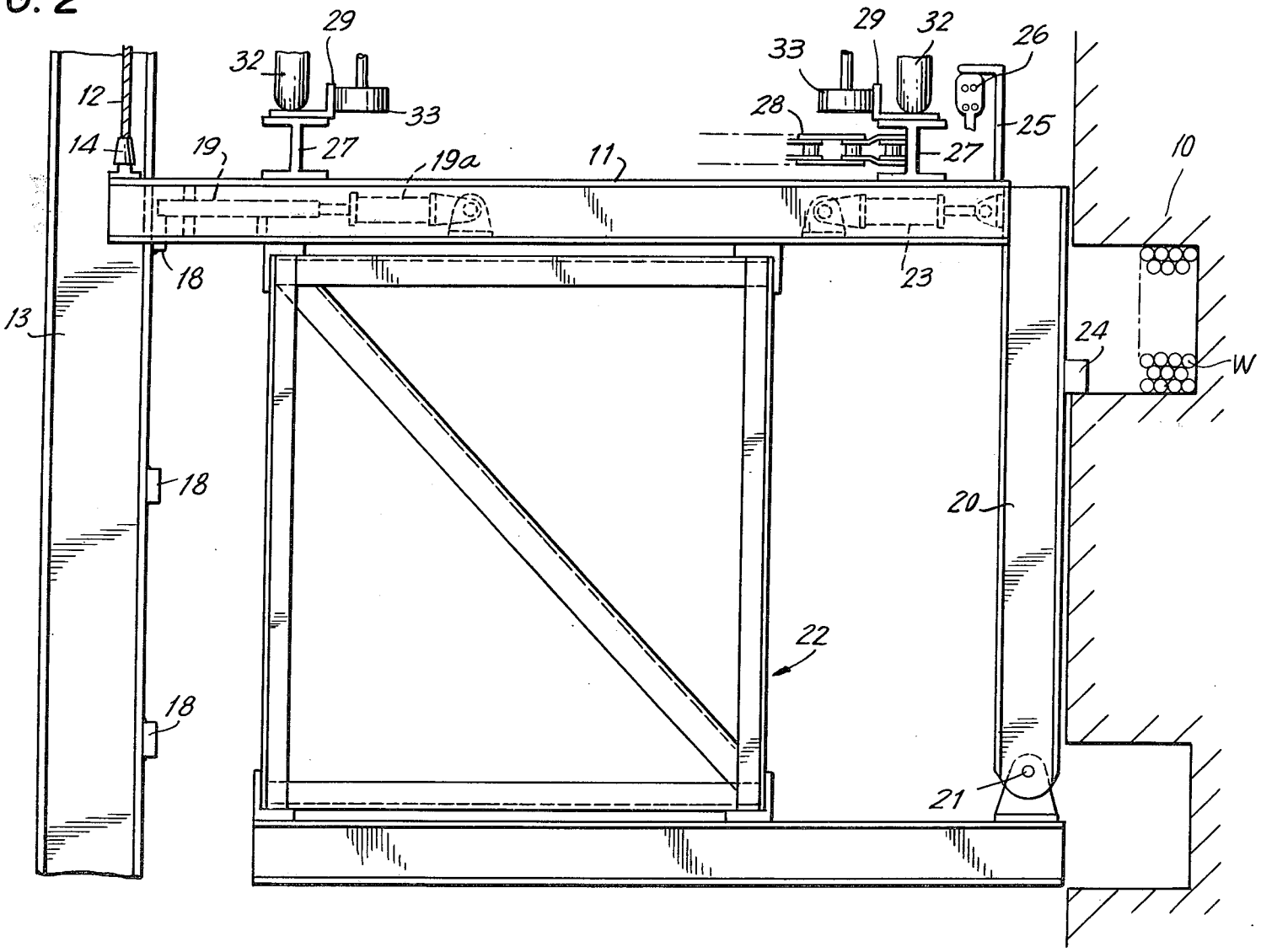
FIG. 2 is a section through the platform showing how the latter may be located in relation to a pressure vessel around which wire is to be wound.

With the apparatus so far described, when it is desired to wind wire into a selected circumferential trough or channel in a pressure vessel, the platform or staging 11 will be set at an appropriate level. Wire will be led from the supply drum 50 on the trolley or carriage 31 via the tensioning unit 40 around the payout sheave 39 on the forward trolley or carriage 30 and into the selected trough or channel where the end will be anchored in any appropriate manner. With the end of the wire anchored, the power unit 34 will be actuated to drive the sprocket 35 and thus to cause the trolleys or carriages 30, 31 to travel around the vessel. As the trolleys or carriages travel around the vessel, the wire W will be drawn from the supply drum 50 via the tensioning unit 40 and will be wound around the vessel. Due to the tensioning unit, the wire will be wound onto the vessel under a predetermined tension. As indicated in our prior U.S. Pat. No. 3,404,497 it is proposed to wind the wire in a plurality of layers in each groove as seen in FIG. 2. When the predetermined number of turns or layers of wire have been wound in a selected groove, the trolleys or carriages will be stopped and the end of the wire will be appropriately anchored, for example, by means of anchor plates, in the groove whereafter the apparatus may then be properly positioned in relation to another trough or channel in readiness for a further winding operation.

The payout sheave 39 performs two functions. Firstly it provides for the turning of the wire through 180° as seen in FIG. 4, and secondly it serves to adjust the pay-off height of the wire so that the strands will be correctly positioned in the trough or channel on the vessel. It is to allow for performance of the second function that provision is made for the before mentioned adjustment of the axis of rotation of sheave 39. The arrangement is such that as one complete passage of wire around the vessel is achieved, the sheave 39 will be tilted by an amount corresponding to the thickness of the wire so that while the point of entry of the wire onto the sheave 39 from the tensioning unit will remain at a constant level, the point of departure of said wire from the sheave will be either raised or lowered by an amount corresponding to the thickness of the wire so that on the next passage around the vessel, the resulting winding will be laid in side by side relationship with the preceding winding with no overlapping of said windings. By arranging for such adjustment of the payout sheave 39, any necessity for adjusting the height of the trolleys or carriages or of the tensioning unit during successive windings will be obviated and within certain limits, pay-off of wire at any required height may be achieved.

Figure 8:
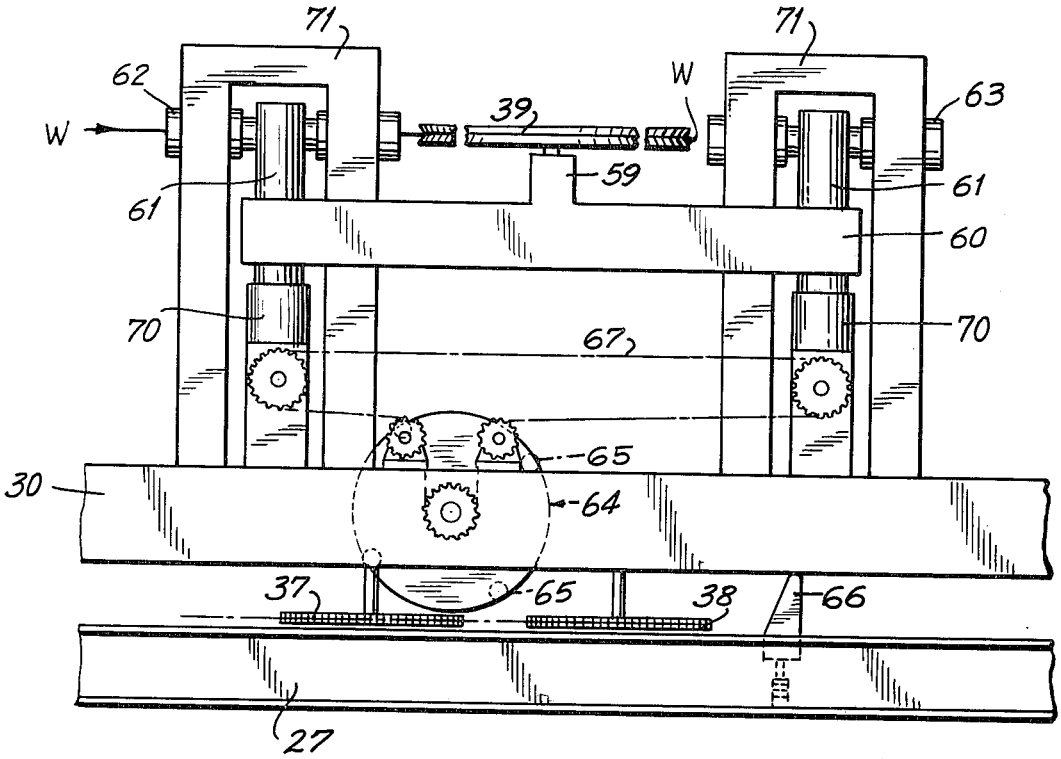
FIG. 8 is a section taken along line 8—8 in FIG. 4 showing the means for tilting the payout sheave.
Figure 9:
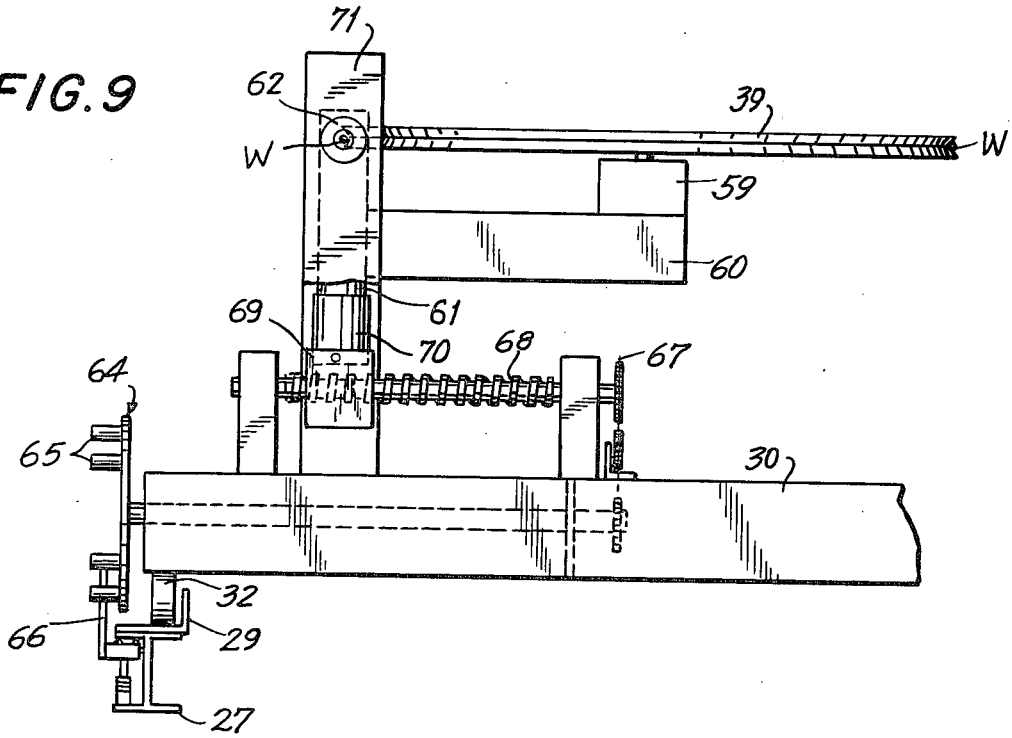
FIG. 9 is a side elevational view of the means in FIG. 8.

The control of the sheave may be effected by the arrangement shown in FIGS. 8 and 9. Therein it is seen that sheave 39 is supported on a bearing 59 on a cross member 60 whose ends are fixed to upright arms 61 secured on trunnions 62,63 which are rotatable in uprights 71 rigidly mounted on platform 30. The wire W passes from supply drum 50 through a hole on the axis of trunnion 62 and enters a groove formed on the periphery of sheave 39.

An indexing system acts on arm 61 to pivot the sheave 39 about the axis of the rotation of the trunnions 62, 63 in the uprights so that the exit point of the wire from the sheave will be vertically moved upon each revolution of the carriage while the entry point of the wire remains the same.

Figure 7:
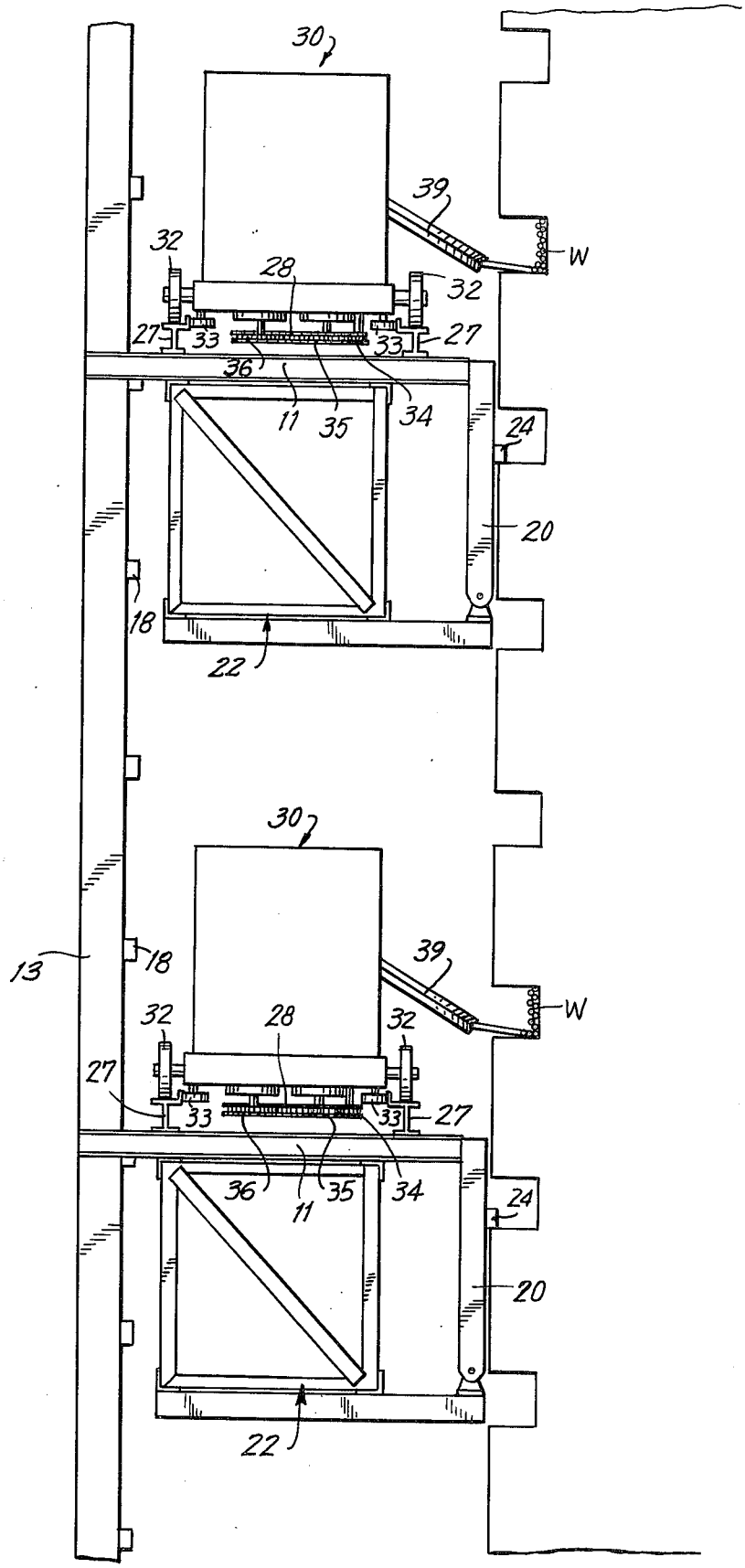
FIG. 7 is an elevational view similar to FIG. 2 but showing two superposed arrangements of platforms and carriages in the course of winding wire simultaneously.

The indexing system in FIGS. 8 and 9 comprises a rotatable cam 64 mounted on the carriage 30, the cam having spaced projecting pins 65 equidistantly arranged thereon. An actuator 66 is fixedly placed on rail 27. When the carriage passes the actuator 66, the latter strikes one of the pins 65 on the cam 64 causing the latter to undergo rotation through a portion of a revolution. A drive chain 67 is driven by the cam 64 and the chain drives a pair of lead screws 68 in rotation a corresponding amount. Each lead screw supports a nut 69 which is pivotably affixed to a lower arm 70 and non-rotatable on its lead screw. The lower arm 70 is telescopically mounted on a respective arm 61 such that, when the lead screws 68 are rotated, the nuts will longitudinally travel a given amount on the respective lead screws and thereby cause arms 61 to pivot with trunnions 62 and 63 in the uprights to produce a corresponding tilting of cross member 60 and sheave 39 carried thereon. The spacing between the projections 65 on the cam 64 is correlated with the pitch on the lead screws and the diameter of the wire so that the sheave will tilt to raise the wire by an amount equal to its diameter once for each revolution of the carriage around the vessel whereby the wire will be laid in superposed rows in the grooves on the vessel as shown in FIGS. 2 and 7. At the end of a winding operation when the wire has reached a topmost location in the particular groove, the cam 64 is driven in the opposite direction either manually or by driving the chain 67 externally until the sheave 39 has reached its initial position and is now ready to lay another line of superposed rows of wire.

Figures 10, 11:
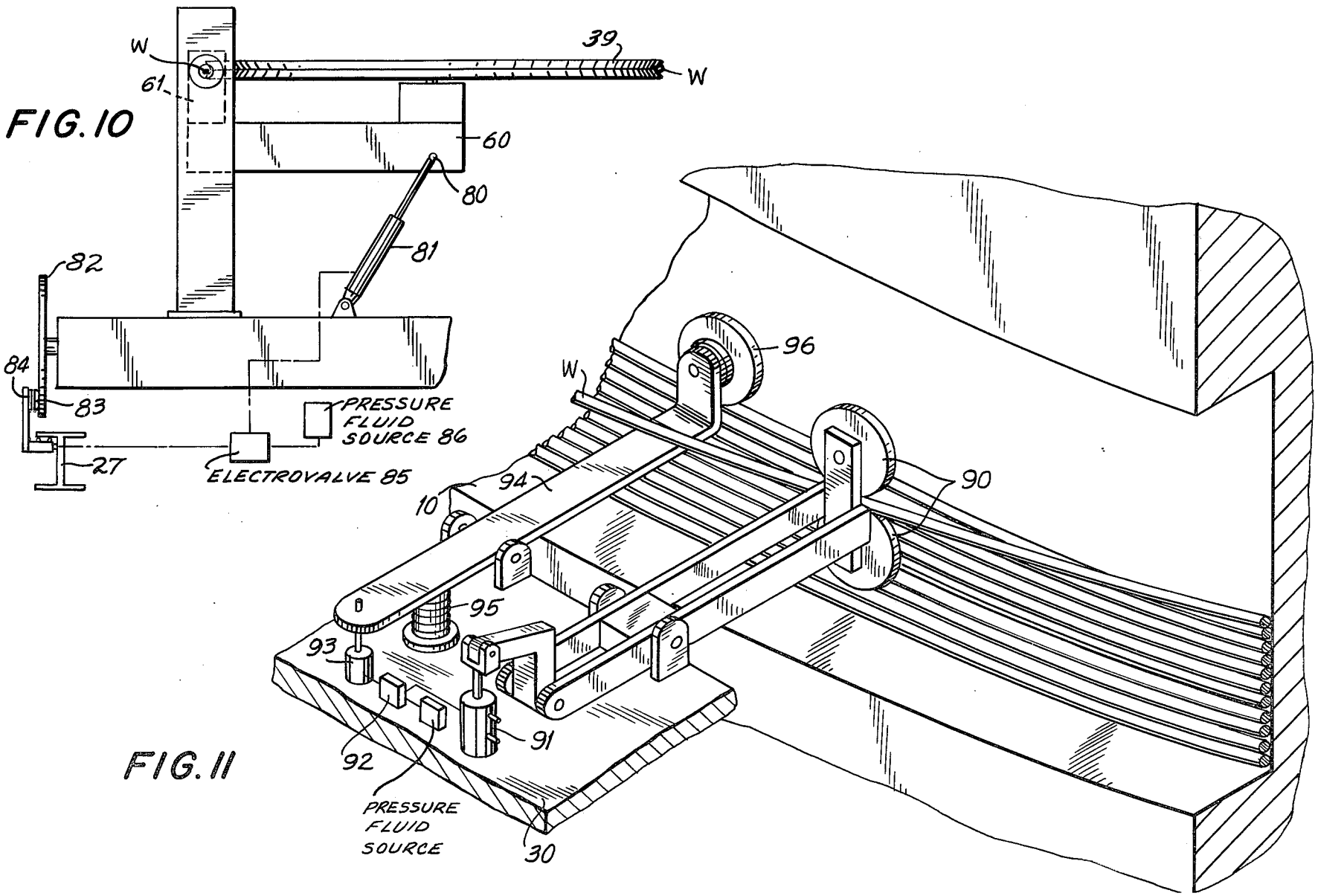
FIG. 10 is a diagrammatic illustration similar to FIG. 9 of a modified arrangement for tilting the payout sheave.
FIG. 11 is a diagrammatic perspective view of a guide arrangement for laying the wire in a groove in the vessel.

FIG. 10 shows a modification of the indexing system in which a hydraulic cylinder system is employed instead of the traveling nuts and lead screws. The sheave 39 is supported on cross member 60 as before, and the cross member 60 is fixed to upper arms 61 secured to trunnions 62 and 63. The cross member 60 is pivotably supported at 80 by the piston rod of a hydraulic cylinder 81 which is actuated to move cross member 60 in steps to tilt sheave 39 and successively wind the wire in superposed rows as before. A trip mechanism is employed to operate the cylinder 81 and comprises a fixed bracket 82 secured to carriage 30 and carrying a magnet element 83. A fixed member 84 is secured to rail 27 and produces an electrical output signal which is received by electrovalve 85 which in turn operates a fluid pressure source 86 to admit pressure fluid to cylinder 81 in a given amount to tilt the sheave 39 a corresponding amount to raise the wire by an amount equal to its diameter once for each revolution of the carriage around the vessel whereby the wire will be laid in superposed rows in the grooves on the vessel. At the end of a winding operation when the wire has reached a topmost location in the particular groove, a signal is fed to electrovalve 85 to cause it to return to its initial position such that fluid will return to the pressure source 80 and cylinder 81 will lower the sheave to its initial position so that it is now ready to lay another line of superposed rows of wire.

It may be mentioned here that it is possible to incorporate a sensing device which would travel in the trough or channel in the vessel and sense any irregularities or tolerance in the latter, such device being effective to transmit a signal to the control means for the sheave so that the position of the latter will be adjusted to ensure correct laying of the wire strand.

In order to ensure that the wire is laid correctly in each groove, it is fed, after passing around the payout sheave 39, through a guide arrangement shown in FIG. 11 comprising two cooperating guide rollers 90 which serve to guide the wire onto the vessel. The position of the rollers 90 is adjustably controlled by a hydraulic cylinder 91, the hydraulic fluid supply of which is controlled by an electrovalve 92 operated by position transducer 93. The transducer 93 responds to pressure applied by pivotal arm 94, the latter being biassed by a spring 95 and carrying at its free end a sensing roller 96 positioned to run in the trough or channel in the pressure vessel on the wound wire. The guide rollers 90 follow the movement of the sensing roller 96 in order to correctly lay the wire in the groove.

It will be appreciated that the apparatus above described may be modified in many respects. Clearly the locking of the platform 11 in any selected position may be effected in many ways other than that hereinbefore described and illustrated. Furthermore, as already mentioned, the number of trolleys or carriages to support the wire supply, the tensioning unit drive means, payout sheave and the necessary control mechanism may be varied. In addition, instead of providing an annular track-supporting platform such as 11 which is raised and lowered by means of a plurality of hoist ropes or cables such as hereinbefore described, any other arrangement of hoist ropes or the like may be employed or it may be desirable to provide some construction wherein such a platform is supported by a plurality of jacks or the like, by means of which raising or lowering of said platform may be effected. The jacks may be located above or below the platform in which former case it would be necessary to provide some structure from which the jacks would be suspended.

In another embodiment as shown in FIG. 7, there are provided upper and lower platforms movable relatively to each other, each platform carrying a respective wire-dispensing mobile unit so that wires are placed simultaneously in two grooves in the vessel.

It may be mentioned here that it may be desirable since an operator stationed in the cabin 47 at the rear of the trolley or carriage 31 will be unable to see the forward part of the leading trolley or carriage 30, to provide a closed circuit television screen in the cabin 47 so that the operator will be able to observe the whole equipment during operation.

While the apparatus described above is intended primarily for the winding of prestressing wire onto a concrete vessel, it may also be utilized to remove loose or tensioned wire, for example, in the case of breakage of the wire or of a fault in winding thereof. In the case of a breakage, the loose end of the wire may be taken back around the payout sheave, through the tensioning device of the supply drum or spool with the spool rotating in the reverse direction and with the trolleys or carriages driven in reverse the wire may readily be wound back on the spool. In the event of a fault in winding, e.g. in the event that one winding is laid over the top of another, by reversing the direction of rotation of the wire drum and reversing the direction of travel of the trolleys or carriages it will be possible to rewind or take off the wire from the vessel back to the point of the fault while still maintaining the tension on the wire and one of the coils already wound. With sufficient wire rewound and the fault remedied the apparatus may then be operated normally to proceed with further winding.

What is claimed is:

1. Apparatus for winding prestressing wire around a cylindrical vessel, said apparatus comprising a platform surrounding the vessel, means for supporting said platform in part from said vessel and in part directly on the ground surrounding the vessel, means for moving said platform vertically upwards and downwards with respect to said vessel, means for locking the platform at a selected height for the winding of wire around the vessel at such height, a track on said platform, a mobile unit supported on said track for movement thereon and around the vessel, means for moving the mobile unit along the track and around the vessel, means on said unit for holding a supply of wire, wire guiding means on said unit for guiding the wire from said supply and winding the wire around the vessel as the unit travels along said track, tensioning means on said unit for engaging the wire as it passes from said supply to produce a given tension in the wire as it is wound around said vessel, means on said unit supporting the wire guiding means for adjusting the position of the latter, in the course of travel of the mobile unit on said track, and thereby the position where the wire is wound on the vessel such that the wire can be wound thereon in superposed rows, and fixed support means adjacent the inner and outer peripheries of the platform, said means for locking the platform comprising means on said platform at angularly spaced locations around both its inner and outer peripheries to engage said support means whereby said platform may be positively locked in place.

2. Apparatus as claimed in claim 1, wherein the tensioning means comprises a tensioning unit including two endless members arranged so that one flight of one is disposed closely adjacent and parallel to one flight of the other, to frictionally grip wire passing between said two flights and produce a predetermined tension in the wire.

3. Apparatus as claimed in claim 2 comprising drive means for driving said endless members to transport the wire therewith.

4. Apparatus as claimed in claim 3, wherein said drive means comprises a drive motor.

5. Apparatus as claimed in claim 2, wherein said tensioning unit comprises fluid pressure operated cylinders pressing the co-operating flights of the endless members together.

6. Apparatus as claimed in claim 1, in which the means for moving the mobile unit along the track comprises a rotatable drive wheel on said unit, and a stationary member encircling the vessel, said drive wheel engaging said stationary member to propel the mobile unit as the drive wheel rotates.

7. Apparatus as claimed in claim 6 comprising means for driving the drive wheel in opposite directions so that the unit may be driven in forward or reverse direction.

8. Apparatus as claimed in claim 6 in which the mobile unit comprises running wheels adapted to engage and run on said track, and means for the lateral guiding of said mobile unit as it travels along the track during a wire winding operation.

9. Apparatus as claimed in claim 6 in which the means for holding the supply of wire comprises a drum on said mobile unit, the wire being led from said drum through the tensioning means, said wire guiding means comprising a rotatable payout sheave mounted on said unit for vertical adjustment of the position at which the wire is fed onto the vessel.

10. Apparatus as claimed in claim 9 comprising means for adjusting the position of the payout sheave after each circuit of the unit around the vessel.

11. Apparatus as claimed in claim 9 wherein said mobile unit comprises two carriages coupled together in tandem, the foremost carrying the payout sheave and the drive wheel while the rearmost carries the tensioning means, and said drum.

12. Apparatus as claimed in claim 11 comprising a plurality of hoist means anchored to said platform at spaced points therearound for moving said platform vertically relatively to the vessel.

13. Apparatus as claimed in claim 12, wherein said hoist means are arranged in pairs, and means for driving the pairs in synchronized relation to ensure that the platform will be maintained substantially horizontal during lifting and lowering.

14. Apparatus as claimed in claim 1 in which the means at the inner periphery of the platform comprises a pivoted arm movable between an inoperative and operative position, a fluid pressure operated ram acting on said arm to move the same between said positions, and a support block on said arm for engaging the support means at the inner periphery when the arm is in said operative position.

15. Apparatus as claimed in claim 1 wherein the means at the outer periphery of the platform comprises projectable and retractable bolts.

16. Apparatus as claimed in claim 9 wherein said wire guiding means further comprises adjustable positioning rollers mounted on the mobile unit for receiving the wire after it leaves the payout sheave to guide the same onto the vessel.

17. Apparatus as claimed in claim 16 wherein said wire guiding means further comprises a sensing roller which travels on said vessel, and means coupled to said sensing roller and said positioning rollers to position the latter in response to the position of the sensing roller.

18. Apparatus as claimed in claim 1 further comprising a second platform adapted to surround the vessel at a selected height in relation thereto, and a second mobile unit supported on said platform for movement around the vessel to wind wire thereon.

* * * * *